US011261580B2

(12) United States Patent
Bolz et al.

(10) Patent No.: US 11,261,580 B2
(45) Date of Patent: Mar. 1, 2022

(54) OPERATING DEVICE FOR AN IMPLEMENT AND IMPLEMENT WITH A CORRESPONDING OPERATING DEVICE

(71) Applicant: Liebherr-Hydraulikbagger GmbH, Kirchdorf/Iller (DE)

(72) Inventors: Gerhard Bolz, Kirchdorf/Iller (DE); Dieter Ansorge, Rot an der Rot (DE); Florian Mang, Memmingen (DE)

(73) Assignee: Liebherr-Hydraulikbagger GmbH, Kirchdorf/Iller (DE)

( * ) Notice: Subject to any disclaimer, the term of this patent is extended or adjusted under 35 U.S.C. 154(b) by 55 days.

(21) Appl. No.: 16/267,308

(22) Filed: Feb. 4, 2019

(65) Prior Publication Data

US 2019/0242094 A1 Aug. 8, 2019

(30) Foreign Application Priority Data

Feb. 2, 2018 (DE) ..... 20 2018 100 592.8

(51) Int. Cl.

| | |
|---|---|
| ***E02F 9/20*** | (2006.01) |
| ***G05G 9/047*** | (2006.01) |
| ***B66F 9/075*** | (2006.01) |
| ***B66C 13/56*** | (2006.01) |

(52) U.S. Cl.

CPC ..... *E02F 9/2004* (2013.01); *B66C 13/56* (2013.01); *B66F 9/0759* (2013.01); *G05G 9/047* (2013.01)

(58) Field of Classification Search

CPC ..... G05G 2009/0474; G05G 9/047; G05D 1/0094; G05D 1/02; G05D 1/0227; E02F 99/2004; E02F 99/0759

USPC ..... 74/469

See application file for complete search history.

(56) References Cited

U.S. PATENT DOCUMENTS

| | | | | |
|---|---|---|---|---|
| 4,685,678 A * | 8/1987 | Frederiksen | A63F 13/06 | 700/85 |
| 5,424,623 A * | 6/1995 | Allen | B25J 9/162 | 180/324 |
| 9,556,589 B2 * | 1/2017 | Brooks | E02F 3/3402 | |
| 2013/0180744 A1 * | 7/2013 | Favreau | E02F 3/7668 | 172/780 |

FOREIGN PATENT DOCUMENTS

WO WO-2010009914 A1 * 1/2010 ..... G05G 9/047

* cited by examiner

*Primary Examiner* — Patrick Cicchino
(74) *Attorney, Agent, or Firm* — McCoy Russell LLP

(57) ABSTRACT

The application relates to an operating device for operating an implement with at least one attachment, comprising at least one manual control unit and at least one controller/regulator, wherein the controller/regulator is equipped to actuate the attachment on the basis of a single control movement of the manual control unit, which is detectable by means of a single detection means provided on the manual control unit, for carrying out a linear movement.

12 Claims, 8 Drawing Sheets

OPERATING DEVICE FOR AN IMPLEMENT AND IMPLEMENT WITH A CORRESPONDING OPERATING DEVICE

CROSS-REFERENCE TO RELATED APPLICATIONS

This present application claims priority to German Application No. 20 2018 100 592.8 entitled "OPERATING DEVICE FOR AN IMPLEMENT AND IMPLEMENT WITH A CORRESPONDING OPERATING DEVICE," filed Feb. 2, 2018. The entire contents of the above-listed application are hereby incorporated by reference in its entirety for all purposes.

TECHNICAL FIELD

This application relates to an operating device for operating an implement with at least one attachment. The attachment comprising at least one manual control unit and at least one controller/regulator.

BACKGROUND AND SUMMARY

Operating devices known from the conventional art for operating implements such as excavators usually can comprise two joysticks that can be pivotable about two axes each. These joysticks can serve for operating the main working movements of the equipment or the implement. For example the joysticks may operate an attachment provided on the implement.

Depending on how the joysticks are moved or along which axes the joysticks are swiveled, cylinders or actuators of the implement are actuated, such as via a controller/regulator for corresponding adjustments of the implement and/or of an attachment.

In the case of attachments that can be moved by means of a plurality of actuators arranged on a working arm, an operator possibly must actuate these actuators, such as in series or one after the other, in a superimposed or simultaneous way in order to effect a desired movement of the attachment.

The conventional art suffers from disadvantages in that to carry out such superimposed movements the operator must carry out awkward control movements by means of the joystick or joysticks and therefore must have a corresponding experience or corresponding capabilities.

Against this background it is the object of the application to provide a simplified or logical operating device for operating an implement, which can also easily be used by beginners or casual operators.

Accordingly, there is provided an operating device for operating an implement with at least one attachment, comprising at least one manual control unit and at least one controller/regulator, wherein the controller/regulator is equipped to actuate the attachment on the basis of a single control movement of the manual control unit, which is detectable by a single detector provided on the manual control unit, for carrying out a linear movement.

A single control movement of the manual control unit here is defined by a single movement or deflection of the manual control unit, which is detectable by means of a single detection means provided on the manual control unit. The detection means only detects a single linear or rotative control movement.

While according to the conventional art such a single control movement is utilized for the actuation and movement of a single actuator of the implement, by which a rotative movement or a swivel movement and hence just no linear movement of the attachment is effected, the controller/regulator of the operating device according to the application creates control signals that linearly move the attachment.

Of course, the manual control unit can be configured such that in the case of a deflection it detects more than one single control movement at the same time, which however according to the application in turn affect a corresponding number of superimposed linear movements of the attachment.

In an embodiment of the application it is conceivable that a first manual control unit is equipped to move the attachment along a first and a second axis, which are perpendicular to each other, and rotate the same about a third axis that is parallel to the first or second axis and is spaced apart from the same.

The first manual control unit for example can be configured as a control stick or joystick, wherein it can be equipped to carry out an at least partly circular or spherical movement along two swivel axes. The movement along the two swivel axes can be converted into control signals that control the attachment for movement along the mutually perpendicular axes via the controller/regulator.

For example, when the first manual control unit is moved or swiveled forwards, based on a working or viewing direction of the implement, this deflection of the manual control unit can be converted into signals that linearly move the attachment forwards. The same applies for pivoting of the manual control unit backwards.

When the manual control unit is moved or swiveled to the left or to the right, this movement of the manual control unit by means of the controller/regulator can be utilized to generate control signals that control the attachment to perform a linear movement to the left or right based on a viewing or working direction of the implement. In the case of superimposed movements of the manual control unit correspondingly superimposed linear movements of the attachment can be represented.

The viewing or working direction of the implement can be a main direction of the implement, in which for example a working arm and/or an uppercarriage of the implement are arranged.

In another embodiment it is conceivable that the attachment is actuatable for rotation by means of a proportional control element.

In an embodiment it can be provided that the at least one manual control unit comprises the proportional control element.

When the manual control unit for example is configured as a joystick or control stick, the proportional control element can be provided thereon. The proportional control element for example can be a slide that can be actuated by a finger or the thumb of a hand for rotating the attachment.

The proportional control element furthermore can comprise a repositioning device, which puts the control element into a neutral position when the control element is not actuated by an operator. The neutral position of the control element can be defined in that no control signals are output to the implement or that a position and/or orientation of the implement and/or of the attachment is not changed.

In another embodiment it is conceivable that a second manual control unit is equipped to rotate the attachment about at least one axis.

An example attachment is an excavator bucket of an excavator wherein the bucket can be swiveled relative to the excavator arm by means of the second manual control unit for picking up and putting down material.

In an embodiment it can be provided that the second manual control unit is equipped to rotate the attachment about at least two axes in particular arranged perpendicular to each other. An attachment rotatable in this way can be an attachment correspondingly pivotable by means of a tilt rotator. The second manual control unit correspondingly can generate control signals for controlling the tilt rotator.

In another embodiment of the application it is conceivable that the at least one manual control unit is partly or exclusively linearly shiftably mounted. This also covers that a handle portion of the manual control unit correspondingly is mounted relative to the further structure of the manual control unit. Such an at least partly linear support of the manual control unit reproduces the actual linear displacement of the attachment in a better way, i.e. more matchingly than commonly used manual control units chiefly or exclusively pivotally mounted.

In another embodiment it is conceivable that the at least one manual control unit and the controller/regulator are equipped to actuate more than one actuator of the implement and/or of the attachment at the same time with a single control movement of the manual control unit in a single direction.

The term of the single control movement of the manual control unit here means, as explained above, that a single detection device of the manual control unit alone detects a corresponding linear or rotatory movement. Of course, more than one detection device can be provided on manual control units so that superimposed movements of the manual control unit still can be converted into correspondingly superimposed but linear movements of the implement and/or of the attachment by means of the controller/regulator. In another embodiment it is conceivable that the implement is an excavator. Another embodiment includes an excavator, comprising at least one operating device as described in one of the embodiments above.

BRIEF DESCRIPTION OF THE DRAWING

Further details and advantages of the application will be explained with reference to an embodiment shown in the Figures by way of example.

DETAILED DESCRIPTION

Figure 1:
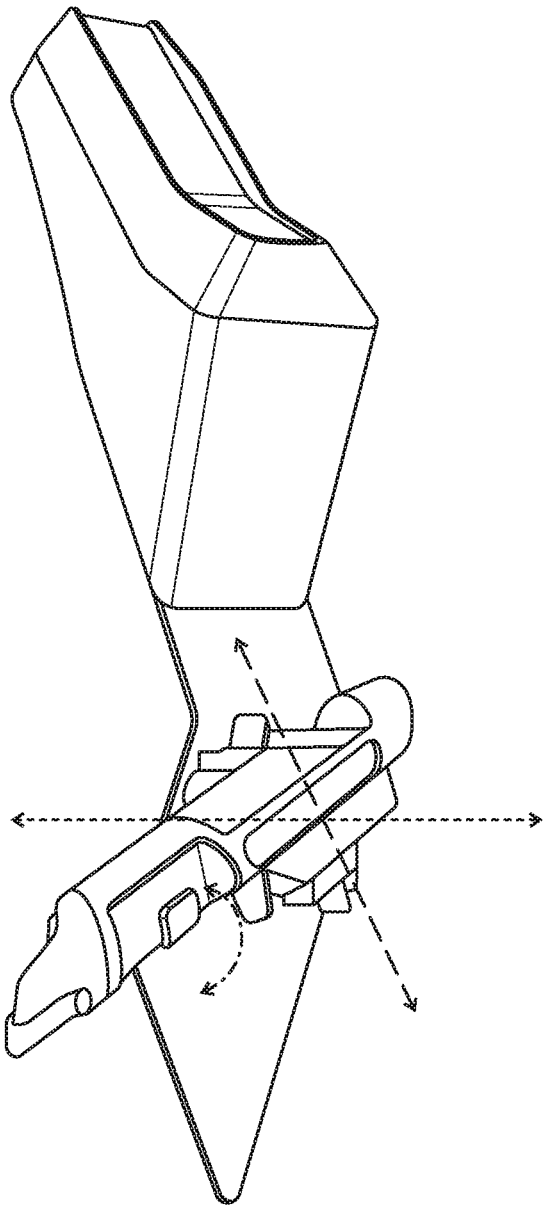
FIG. 1 shows a manual control unit on the left and its directions of movement.

FIG. 1 shows a manual control unit 1 of an operating device according to the application and its direction of movement designated by arrows. The illustrated manual control unit 1 can be the left one of two manual control units of an operating device 5.

As shown in FIG. 1, the manual control unit 1 can be shifted or pivoted along two axes, 2 and 3, arranged perpendicular to each other and furthermore can comprise a control element 6 that can be pivoted in two directions along a rotational axis 4 by means of a finger or the thumb of a hand.

Figure 2:
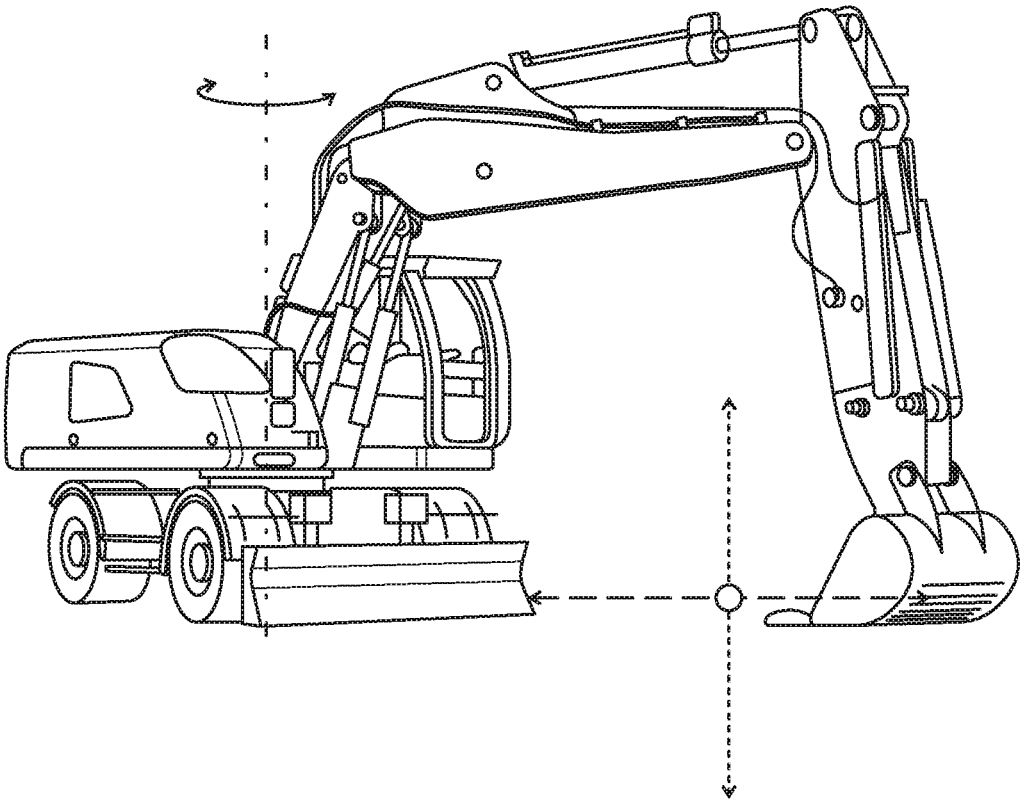
FIG. 2 shows the allocation of the machine movement to the left manual control unit.

As can be taken from FIG. 2, pivoting of the control element 6 can control the rotation of the uppercarriage of an implement along the rotational axis 4, while the movement of the manual control unit 1 along the mutually perpendicular axes 2 and 3 can be used for actuating linear and possibly superimposable movements of an attachment such as an excavator bucket 8 of the implement 7.

While in conventional machine control units the hand of an operator moves on a circular path to be described by two axes of rotation and for each axis a movement of the implement is controlled, the movement described here can be effected on linear, possibly superimposable paths. The actuation can be effected inversely. This means that proceeding from the a linear hand movement a linear movement of the boom and/or of the attachment or generally of the implement can also be effected. For example, if the manual control unit 1 is moved along axes 2 and 3 this movement can be translated to a movement by the bucket 8 moving along the corresponding axes 2 and 3. This movement may be superimposed with regard to axes 2 and 3. Thus, the individual movements of a boom, a dipper arm, a bucket and/or an adjustable boom can be actuated in a superimposed way. These movements can also be executed in inverse directions relative to the axes 2 and 3. In an exemplary embodiment, a movement away from the operator by the control unit 1 along axes 2 would produce a movement of the bucket 8 toward the operator along axes 2.

In the following, the functions of the two manual control units will be explained. As mentioned already, a linear movement of the tool can also be triggered by a linear hand movement.

The left manual control unit can determine the boom and machine movements. In FIG. 1 the main directions along axes 2 and 3 are shown. Beside the two linear and intersecting directions of movement a rotatory actuating control element 6 is provided. The assignment of the excavator movements to the movements of the control element 6 along rotational axis 4 is shown in FIG. 2.

The movement of the manual control unit 1 produces a coordinated movement of the tool. The joints of an articulating arm or tool are no longer are moved individually and the actuators no longer are actuated individually, but the attachment (e.g. cutting edge at the bucket) is controlled directly. In one embodiment, the rotation of the uppercarriage can be effected via a finger-actuated proportional control element, such as control element 6, while linear movement of the chosen tool can effected by linear movement of a control unit, such as manual control unit 1.

Figure 3:
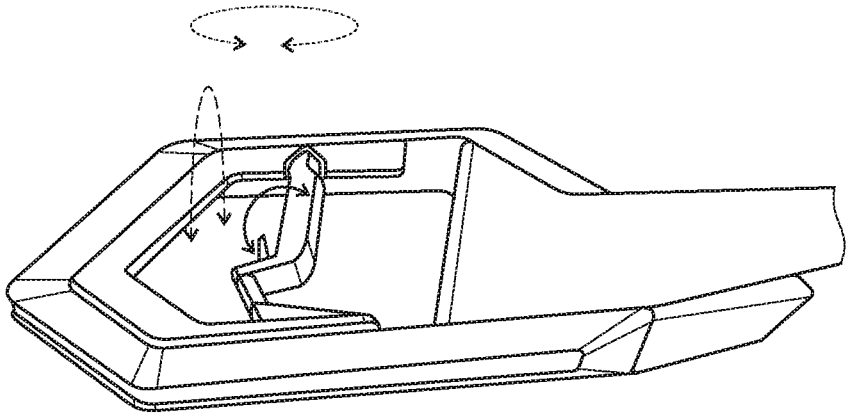
FIG. 3 shows the right manual control unit and its directions of movement.

An embodiment of another manual control unit shown in FIG. 3. This embodiment may serve as a right handed control unit while a left handed control unit is similar to that depicted in FIG. 1 for operating the attachment. For this reason, the right control element can be configured for rotatory movements. The degrees of freedom along rotational axes 9, 10 and 11 of the right hand control element 12 correspond to the kinematics of the most frequently used attachments, such as a bucket and/or a tilt rotator.

The operation of the axes 9, 10 and 11 shown in dashed lines in FIG. 3 can be effected via a tension control and not via a deflection of the right hand control element 12. In the case of rotatory movements, this kind of operation provides for better ergonomics of the control element.

Figure 4:
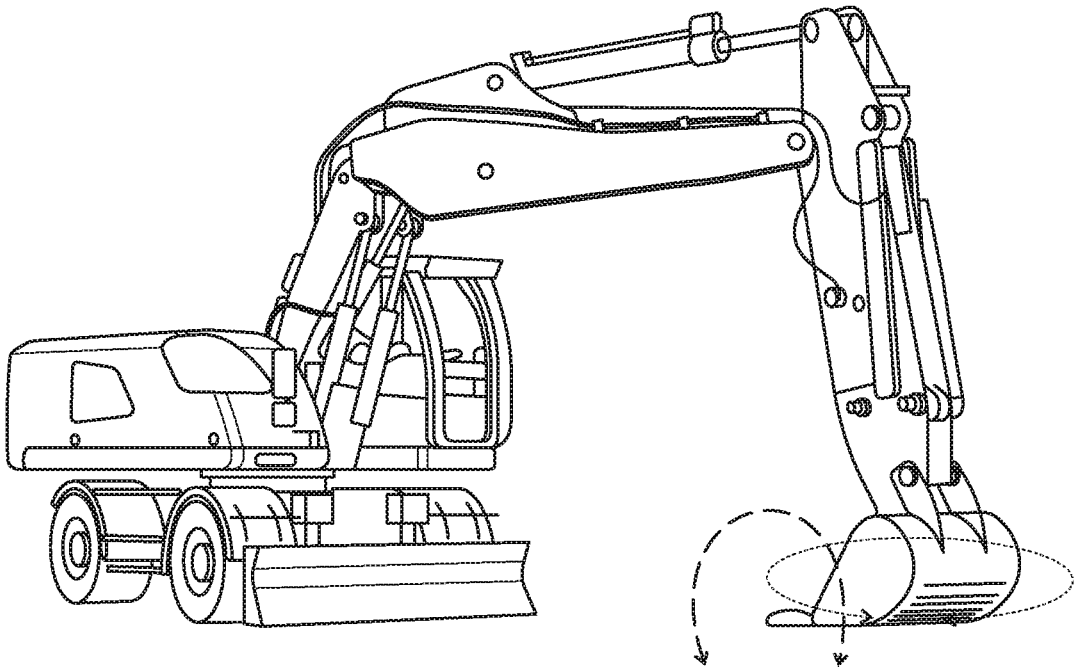
FIG. 4 shows the allocation of the tool movement to the right manual control unit.
Figure 5:
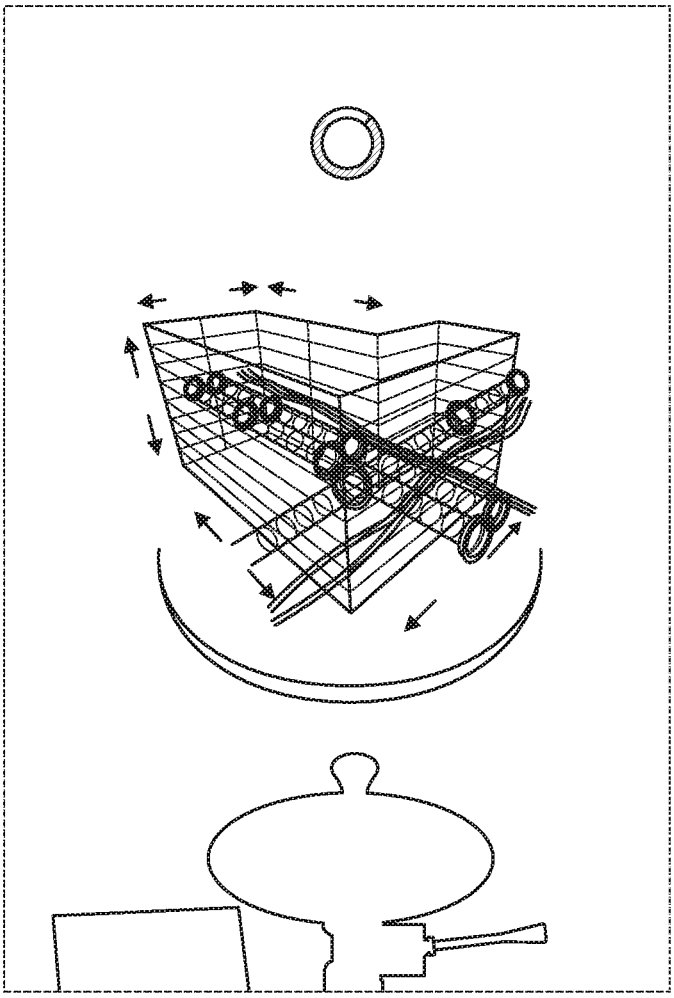
FIG. 5 shows operation and direction of a control unit.
Figure 6:
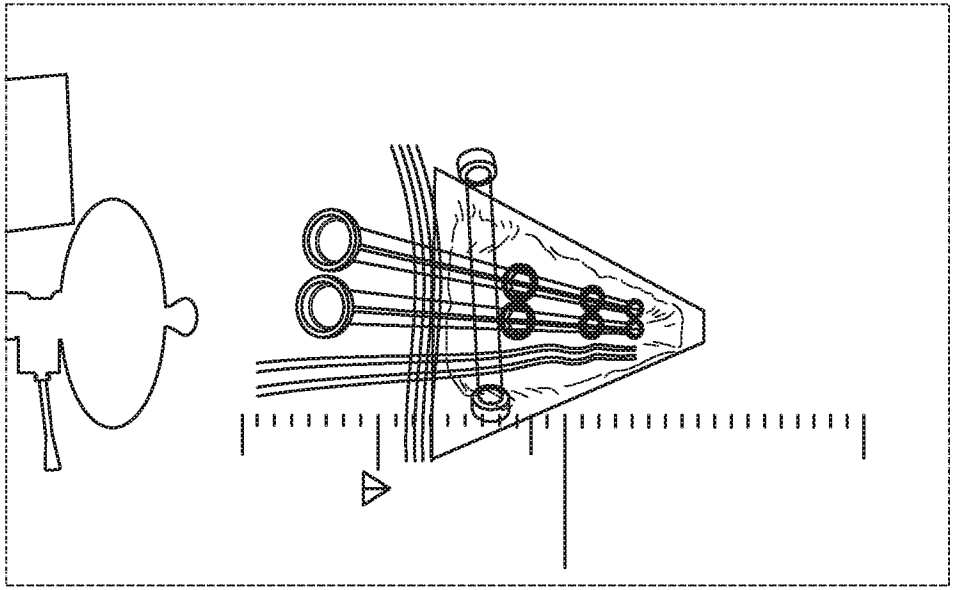
FIG. 6 shows operation and a display of a control unit.
Figure 7:
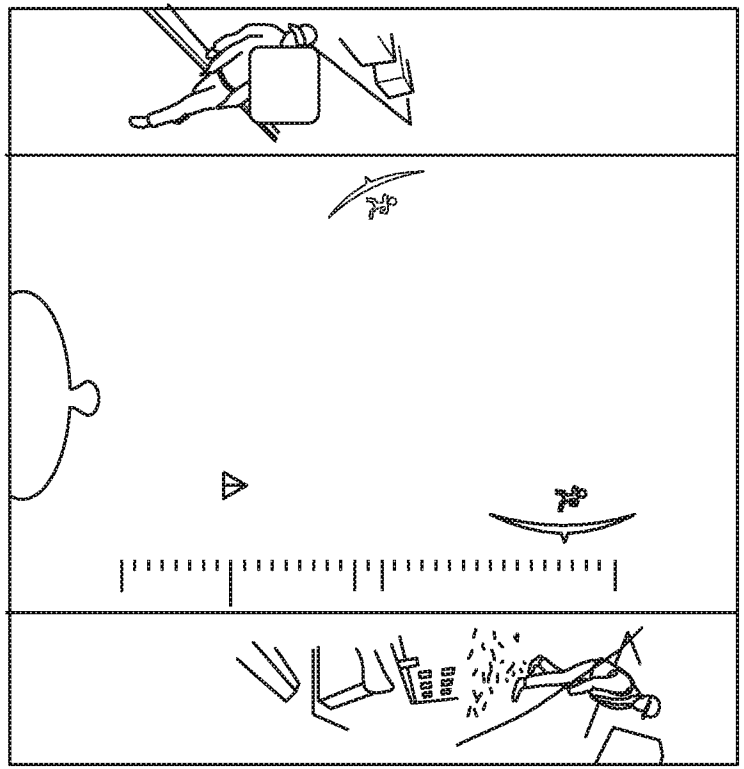
FIG. 7 shows operation and a display of a control unit.

The assignment of the movements of the right hand manual control unit 12 along axes 10 and 11 are shown relative to an excavator 7. The third axes 9 may be used for further embodiments such a three axes adjustable blade. FIG. 4.

Instead of the current two-handed joystick operation (Euro control) an alternative two-handed operation is considered here. The necessary control elements can be resonantly arranged on the driver's seat above a spring pack and be adjustable in relation to the driver. The arrangement and design of the control elements can be effected according to ergonomic design principles. In addition, a display can be arranged on the seat system.

The simplified and logical operation of the machine for beginners and casual operators corresponds to the operating philosophy of the application. For this purpose, the Euro control and the conventional structure of the encoder units are replaced. While with the conventional machine control unit the hand moves on a circular path and per axis one movement or one actuator is controlled, the movement described here shall be effected on linear paths. The actuation may be effected inversely. This intuitive and corresponding movement connection between the axes of the control units and the implement to be controlled will ease the use of such a machine, especially for inexperienced users.

This means that proceeding from the linear hand movement a linear movement of the boom and of the attachment also is affected. For this purpose, the individual movements of the boom, the dipper arm, the bucket and/or the adjustable boom are actuated in a superimposed way. This connection of the movement of the control unit directly connected to the implement, such as manual control unit 1 and bucket 8, simplifies operation of the machine. Conventional designs often require individual joints of a tool, such a boom arm, to be articulated individually. In contrast, the application describes a control unit producing directly corresponding movements in an implement.

As a further simplification of the machine operation, a tutorial and assistance application can be provided for the machine and attachments.

The bucket tilting movement can be controlled via the right manual control element. When using a tilt rotator, one approach would be to actuate the rotation and tilt movement in a tension-controlled way. The directions of tension are represented in FIG. 3 as dashed circular arcs.

Figure 8:
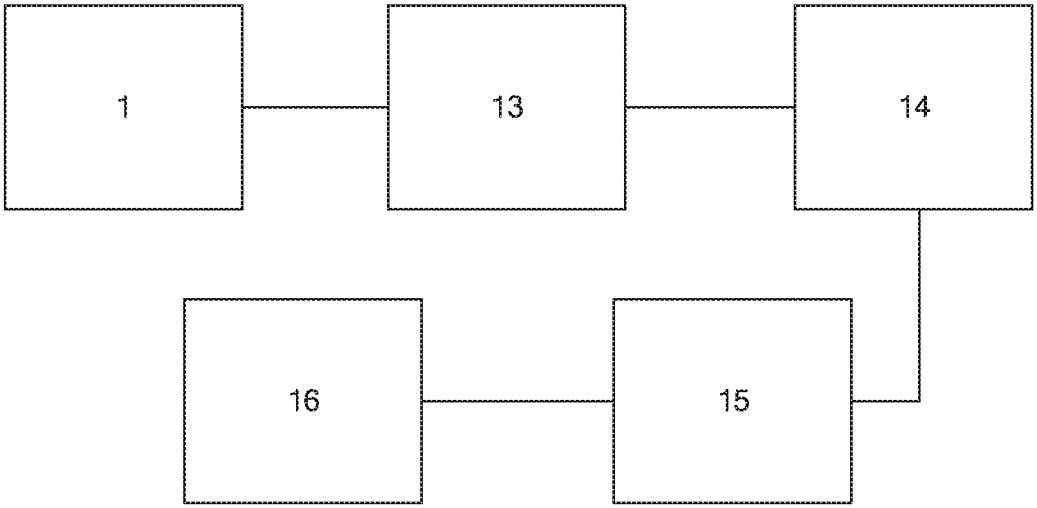
FIG. 8 shows a progression of signals and movements through various components to an implement.

FIG. 8 shows how communication signals are sent based on movement of a control unit, such as a manual control unit 1, to actuators 15 that produce movement of implement 16, such as bucket 8. An operator may move a control unit 1 and this movement is detected by a detector 13. The detector 13 may be a single detector which collects all movement data of the control unit 1. There may also be two detectors 13. In one embodiment one detector 13 is mounted in the base of control unit 1 and detects linear movement while a second detector 13 is mounted to detect the movement of a control element 6 which may detect a rotational movement. The detector or detectors 13 then send signals to a controller/regulator 14. The controller/regulator 14 controls one more actuators 15 which control the movement of the implement 16. In the embodiment shown in FIG. 2, a controller/regulator 14 controls actuators in the excavator arm the move the position of bucket 8.

The invention claimed is:

1. An operating device for operating an implement with at least one attachment, the operating device comprising:

a first manual control unit and at least one controller/regulator, actuators positioned on axes oriented in different directions, wherein the controller/regulator is equipped to actuate the attachment on the basis of a single control movement of the first manual control unit and the single control movement is detectable by means of a single detector, for carrying out a linear movement, wherein in response to two or more simultaneous control movements of the first manual control unit in two or more directions, the controller/regulator actuates two or more of the actuators simultaneously to produce movement of a tool in directions superimposed with the two or more simultaneous control movements, and the two or more actuators actuated being oriented in different directions from the directions of the two or more simultaneous control movements or the movement of the tool, wherein rotation of a control around a rotational axis of the first manual control unit produces rotation of an upper carriage of the operating device, and wherein rotation of a second control unit about its vertical axis produces a superimposed rotation of the tool and rotation of the second control unit about one of its horizontal axis produces a superimposed rotation of the tool.

2. The operating device according to claim 1, wherein the first manual control unit is equipped to move the attachment along a first and a second axis, which are perpendicular to each other, and rotate the attachment about a third axis that is parallel to the first or second axis and is spaced apart from the first or second axis.

3. The operating device according to claim 1, wherein the attachment is actuatable for rotating by means of a proportional control element.

4. The operating device according to claim 3, wherein the first manual control unit comprises the proportional control element.

5. The operating device according to claim 1, wherein the at least one manual control unit is partly or exclusively linearly shiftably mounted.

6. The operating device according to claim 1, wherein the implement is an excavator.

7. The operating device according to claim 1, wherein the second manual control unit is equipped to rotate the attachment about at least two axes arranged perpendicular to each other.

8. An operating device for operating an implement with at least one attachment, the operating device comprising:

a first manual control unit, actuators positioned on axes oriented in different directions, and at least one controller/regulator that actuates the attachment based on a control movement of the manual control unit and the control movement is detectable by a single detector, wherein in response to two or more simultaneous control movements of the manual control unit in two or more directions, the at least one manual control unit and the controller/regulator actuate two or more of the actuators simultaneously to produce movement of a tool in directions superimposed with the two or more simultaneous control movements, and the two or more actuators actuated being oriented in different directions from the directions of the two or more simultaneous control movements or the movement of the tool, wherein rotation of a control around a rotational axis of the first manual control unit produces rotation of an upper carriage of the operating device, and wherein rotation of a second control unit about its vertical axis produces a superimposed rotation of the tool and rotation of the second control unit about one of its horizontal axis produces a superimposed rotation of the tool.

9. The operating device of claim 8, wherein a movement of the first control unit produces a corresponding movement of a tool.

10. The operating device of claim 9, wherein the tool is located at the end of an articulable arm which includes two or more actuating joints and the movement of the first manual control unit does not actuate individual actuating joints.

11. The operating device of claim 10, wherein a control movement of the first manual control unit relative to two control unit axes produces a corresponding movement by the tool on two tool axes, and the control unit axes and tool axes are superimposed.

12. The operating device of claim 11, wherein the corresponding movement of the tool is an inverse direction to the control movement.

* * * * *